US007730560B2

(12) United States Patent
Markaj

(10) Patent No.: US 7,730,560 B2
(45) Date of Patent: Jun. 8, 2010

(54) ODORLESS TOILET

(76) Inventor: Viktor Markaj, 5925 N. Drake, Chicago, IL (US) 60659

( * ) Notice: Subject to any disclaimer, the term of this patent is extended or adjusted under 35 U.S.C. 154(b) by 723 days.

(21) Appl. No.: 11/714,631

(22) Filed: Mar. 6, 2007

(65) Prior Publication Data

US 2008/0216220 A1 Sep. 11, 2008

(51) Int. Cl.
*E03D 9/04* (2006.01)

(52) U.S. Cl. ..... 4/213; 4/217; 4/219; 4/352; 4/347; 4/209 R

(58) Field of Classification Search ..... 4/213, 4/211, 216, 217, 219, 347–352
See application file for complete search history.

(56) References Cited

U.S. PATENT DOCUMENTS 2,777,137 A * 1/1957 McFadden
3,122,757 A * 3/1964 Sowards
4,365,361 A * 12/1982 Sanstrom
4,494,255 A * 1/1985 Drummond
5,355,536 A 10/1994 Prisco
5,386,594 A * 2/1995 Hilton
5,704,074 A * 1/1998 Baldea
6,637,040 B1 10/2003 Alba
6,772,449 B1 8/2004 Wolfe
7,103,925 B2 9/2006 Toth
7,117,548 B1 10/2006 Reyes
2006/0037127 A1 2/2006 Chen
2006/0085897 A1 4/2006 Birdsong

* cited by examiner

*Primary Examiner*—Khoa D Huynh

(57) ABSTRACT

The present invention provides an odorless toilet comprising an adapter ring compressed between a toilet horn and a sewer pipe flange and having a hollow core, an adapter inlet and an exhaust vent; a seat having at least one intake port, a gas cavity and a gas cavity exhaust port; a fan having a fan inlet and a fan exhaust, the fan inlet connected to the gas cavity exhaust port and the fan exhaust connected to the adapter inlet, wherein when the fan is operating, a negative pressure develops in the seat gas cavity, and the odor is pulled into the seat gas cavity through at least one intake port and exhausted from the gas cavity exhaust port to the adapter inlet and then channeled into a sewer pipe through the exhaust vent, wherein the exhaust vent of the adapter ring extends below the sewer pipe flange, wherein the adapter ring has an opening through the center to allow unobstructed passage of waste matter from the toilet horn to a sewer pipe when the toilet is flushed.

9 Claims, 5 Drawing Sheets

ODORLESS TOILET

FIELD OF THE INVENTION

The present invention relates to toilets, and more particularly to odorless toilet systems.

BACKGROUND OF THE INVENTION

Numerous approaches have been taken to address the embarrassing and unpleasant problem of toilet order. To date, the most prevalent approach has been to employ a ceiling fan to evacuate odor. Ceiling fans are an inefficient solution because they not only remove odor from a toilet bowl but also the surrounding air in the bathroom at large.

This may cause a stark cooling of the bathroom in winter due to the evacuation of warm air. In addition, the ceiling fan may cause the unintended heating of bathroom in summer due to the evacuation of cooled air. Furthermore, ceiling fans invariably require time to clear the air from a room because they imprecisely draw air up several feet from the toilet bowl up to the ceiling, thereby unnecessarily filtering the ambient air of the bathroom.

The prior art also discloses several configurations for removing odors from a toilet employing a ventilated seat to draw odors from the vicinity of the toilet bowl. Several of these patents disclose a system for evacuating odor through an exhaust vent to a remote location such as unused attic space or outdoors.

U.S. Pat. No. 5,355,536 discloses a bathroom exhaust system that includes a ventilated toilet seat assembly, one or more exhaust lines connected to the ventilated toilet seat through a mounting block attached to the toilet bowl behind the toilet seat and an exhaust fan located in or adjacent to the ceiling of the bathroom. The exhaust fan is vented to the outside atmosphere and is controlled by an electrical switch mounted on the wall of the bathroom. The ventilated toilet seat assembly includes a toilet seat that has a hollow interior and a plurality of vent apertures permitting communication with the interior of the toilet bowl. An exhaust line is provided at the rear of the toilet seat and cooperates with an exhaust passageway in a mounting block attached to the top of the toilet bowl just in front of the water tank and behind the toilet seat. The mounting block also includes the hinges for pivoting the toilet seat. One or more exhaust couplings extend from the end of the mounting block and a flexible exhaust hosing is attached to the exhaust couplings and extends to the exhaust fan located in an exhaust fan housing in the ceiling of the bathroom.

U.S. Pat. No. 7,103,925 B2 discloses an odor eliminating system utilizing an air pump to remove odors from a bowl of a toilet to a trap of the toilet. By moving the odors to the trap, the odors cannot escape back to the bowl and can only proceed out of the toilet to the sewer. The system can be adapted to existing toilets by drilling a channel to the trap or the system can be incorporated into new toilets. To retrofit an existing toilet, a channel is drilled in the porcelain unified body of the toilet to a spot above the water level in the inverted-U-section of the trap. To prevent water that is flushed from the toilet from escaping through the channel, the channel should be sloped downward (preferably vertically) into the trap. For example, the channel can be formed by drilling a channel from the top of the toilet, near the seat into the trap. The outlet tube is then connected to the channel. To prevent the odors from escaping and to prevent sewer gases from escaping the trap, the outlet tube must fit in an airtight manner.

U.S. Pat. No. 7,117,548 B1 discloses a toilet ventilation system for use with a typical toilet. The system comprises a seat of an oval shape matching the toilet. A pair of seat swivel mounts at a rear of the seat are attached to a toilet bowl top. A plurality of vacuum intake holes are disposed on a lower side of the seat. A vacuum canal is enclosed within the seat and communicates with the vacuum intake holes. The vacuum canal terminates in a flexible vacuum outlet proximal to one swivel mount. A vacuum hose is connected to the flexible vacuum outlet. A conical vacuum pump is connected to the vacuum hose. An electric vacuum motor is integrally connected within the vacuum pump, and a check valve is integrally disposed within a top of the conical vacuum pump, whereby exhausted gasses are prevented from returning through the check valve. An exhaust is connected to the check valve such that the conical vacuum pump, integral vacuum motor, integral check valve, and exhaust are fitted within a bowl cavity of the toilet. A sewer hose is connected to the exhaust and exits the bowl cavity and connects to a sewer pipe below the toilet, such that the sewer hose is concealed within the bowl cavity, a floor, and the sewer pipe below the toilet.

These approaches do not present an optimal system for removing odors because they require extensive physical alterations to bathroom plumbing and ventilation systems. An approach requiring the drilling of a hole in the floor or sewer line is difficult and labor intensive. Moreover, many toilets located on the ground floor would require the formidable task drilling of a hole through concrete in order to reach the sewer pipe.

Retrofitting of existing toilets may also create problems under the approaches set forth in the prior art. Drilling a channel through layers of toilet porcelain can be a difficult task for the average homeowner. Building codes in certain jurisdictions may preclude the drilling of holes in ventilating cast iron pipes. Lastly, potential users could be deterred from invasive systems that require the drilling of holes into expensive marble or granite.

In light of the shortcomings in the prior art, a system for odor removal is desired that employs a ventilated seat to evacuate odor into a sewer pipe without requiring the drilling of holes into walls, flooring or the sewer pipe. The ideal system will require the minimal amount of alternations to the existing toilet infrastructure, have a low-cost, and will be widely applicable to any toilet without requiring major modifications to conventional toilets currently on the market. The present invention solves these problems.

SUMMARY OF THE INVENTION

The present invention provides an odorless toilet comprising an adapter ring compressed between a toilet horn and a sewer pipe flange and having a hollow core, an adapter inlet and an exhaust vent; a seat having at least one intake port, a gas cavity and a gas cavity exhaust port; a fan having a fan inlet and a fan exhaust, the fan inlet connected to the gas cavity exhaust port and the fan exhaust connected to the adapter inlet, wherein when the fan is operating, a negative pressure develops in the seat gas cavity, and the odor is pulled into the seat gas cavity through at least one intake port and exhausted from the gas cavity exhaust port to the adapter inlet and then channeled into a sewer pipe through the exhaust vent, wherein the exhaust vent of the adapter ring extends below the sewer pipe flange, wherein the adapter ring has an opening through the center to allow unobstructed passage of waste matter from the toilet horn to a sewer pipe when the toilet is flushed.

In one embodiment, the odorless toilet further comprises a one-way check valve between the fan and adapter to prevent odors and backflow from re-entering the toilet bowl.

In another embodiment, the odorless toilet further comprises a switch to turn the fan on and off.

In yet another embodiment, a seat gasket is fixed to the lower surface of the seat to prevent odors from escaping the toilet bowl.

In still another embodiment, the switch is located below the seat. In one embodiment, the switch is a mercury switch. In another embodiment, the switch is a pressure switch.

In one embodiment, the adapter ring is defined by an annular upper wall, an annular outer wall, an annular bottom wall, and an annular inner wall, wherein a wax ring is affixed to and extends upward from the bottom wall to the outer wall and upper wall to provide an impermeable seal between the toilet horn and adapter ring, and between the adapter ring and toilet flange. In another embodiment, the adapter ring is integrally formed around the toilet horn of a toilet. In yet another embodiment, the adapter ring is made of plastic. In still another embodiment, the adapter ring is made of stainless steel.

In one embodiment, the adapter ring comprises a hollow core, an adapter inlet, an exhaust vent, and a central opening to allow unobstructed passage of waste matter from the toilet horn to a sewer pipe when the toilet is flushed; the exhaust vent of the adapter ring extending below the sewer pipe flange to channel the odor into the sewer pipe; the adapter ring adapter ring having an annular upper wall, an annular outer wall, an annular bottom wall, and an annular inner wall, wherein a wax ring is affixed to and extends upward the from bottom wall to the outer wall and upper wall to provide an impermeable seal between the toilet horn and adapter ring, and between the adapter ring and toilet flange.

In another embodiment, the present invention provides an odorless toilet comprising an adapter ring compressed between a toilet horn and a sewer pipe flange, having a hollow core, an adapter inlet and an exhaust vent; the exhaust vent of the adapter ring extending below the sewer pipe flange to channel the odor into the sewer pipe; the adapter ring adapter having an annular upper wall, outer wall, bottom wall, and inner wall, wherein a wax ring is affixed to and extends upward the from bottom wall to the outer wall and upper wall to provide an impermeable seal between the toilet horn and adapter ring, and between the adapter ring and toilet flange; a seat having at least one intake port, a gas cavity and a gas cavity exhaust port; a fan having a fan inlet and a fan exhaust, the fan inlet connected to the gas cavity exhaust port and the fan exhaust connected to the adapter inlet, wherein when the fan is operating, a negative pressure develops in the seat gas cavity, and the odor is pulled into the seat gas cavity through at least one intake port and exhausted from the gas cavity exhaust port to the adapter inlet, wherein the adapter ring has an opening through the center to allow unobstructed passage of waste matter from the toilet horn to a sewer pipe when the toilet is flushed; a one-way check valve between the fan and adapter to prevent odors and backflow from re-entering the toilet bowl; a switch to turn the fan on and off, wherein the switch is located below the seat; a gasket affixed to the lower surface of the seat to prevent odors from escaping the toilet bowl.

In one embodiment, the adapter ring is affixed to a planar plate that fits the contours of a toilet base.

In still another embodiment, the present invention provides an adapter ring comprising a hollow core, an inlet, an exhaust vent, and a central opening to allow unobstructed passage of waste matter from the toilet horn to a sewer pipe when the toilet is flushed; the exhaust vent of the adapter ring extending below the sewer pipe flange to channel the odor into the sewer pipe; the adapter ring affixed to a planar plate that is shaped to fit the contours of the base of a toilet, thereby forming an adapter plate; the plate having a sufficient height to accommodate an adapter inlet, the plate having two apertures to accommodate a pair of flange bolts.

In yet another embodiment, the seat has a channel extending around the bottom surface of the toilet seat, wherein the channel is covered with a surface containing at least one intake port.

In one embodiment, the present invention provides an odorless toilet that can be mounted on a wall comprising, an adapter ring compressed between a waste outlet and a drain pipe and having a hollow core, an adapter inlet and an exhaust vent; the exhaust vent of the adapter ring extending into the drain pipe to channel the odor into the drain pipe; the adapter ring adapter having an annular upper wall, an annular outer wall, an annular bottom wall, and an annular inner wall, wherein a sealing ring is affixed to and extends upward the from bottom wall to the outer wall and upper wall to provide an impermeable seal between the waste outlet and the drain pipe; a seat having at least one intake port, a gas cavity and a gas cavity exhaust port; a fan having a fan inlet and a fan exhaust, the fan inlet connected to the gas cavity exhaust port and the fan exhaust connected to the adapter inlet, wherein when the fan is operating, a negative pressure develops in the seat gas cavity, and the odor is pulled into the seat gas cavity through at least one intake port and exhausted from the gas cavity exhaust port to the adapter inlet, wherein the adapter ring has an opening through the center to allow unobstructed passage of waste matter from the outlet to the drain pipe when the toilet is flushed; a one-way check valve between the fan and adapter to prevent odors and backflow from re-entering the toilet bowl; a switch to turn the fan on and off, wherein the switch is located below the seat; a gasket affixed to the lower surface of the seat to prevent odors from escaping the toilet bowl.

In another embodiment the sealing ring is neoprene. In yet another embodiment, the sealing ring is graphite-felt.

BRIEF DESCRIPTION OF THE DRAWINGS

The features of this invention will be understood more fully and clearly apparent from the following description made in connection with the accompanying drawings wherein like reference numbers and characters refer to similar parts throughout the several views, and in which.

DETAILED DESCRIPTION OF THE INVENTION

Figure 1:
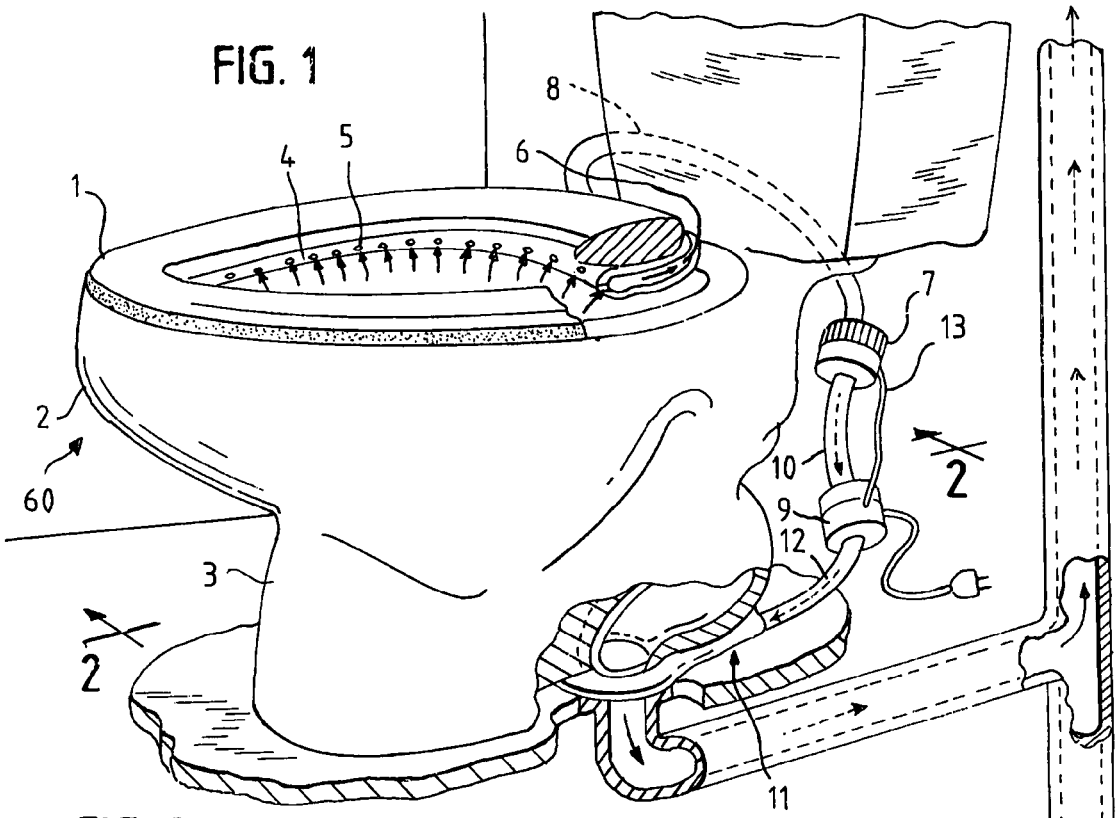
FIG. 1 is a partial isometric view of the odorless toilet.
Figure 2A:
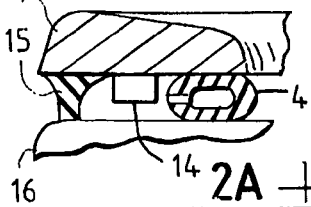
FIGS. 2A and 2B are cross-sectional views of the toilet seat.
Figure 2B:
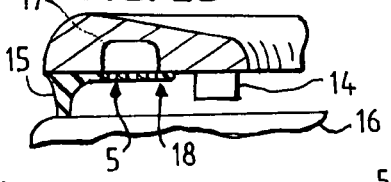
Figure 2:
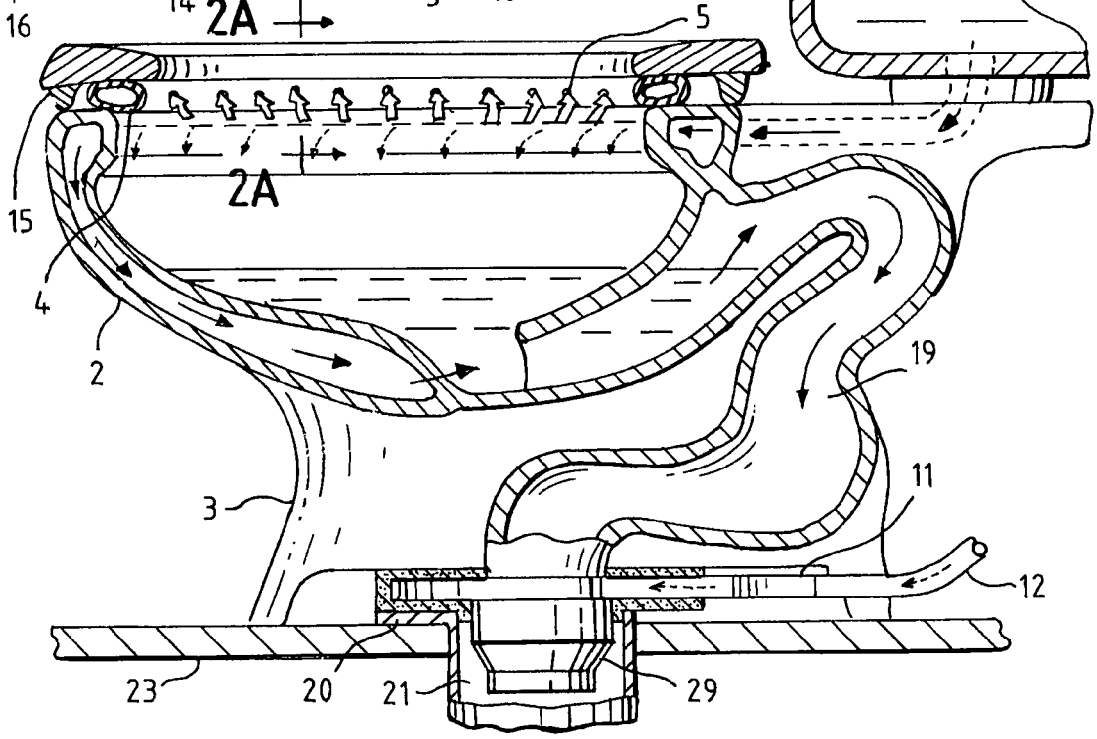
FIG. 2 is a cross-sectional view of the toilet of FIG. 1 illustrating the evacuation of odor through the intake port, adapter inlet and down through the sewer pipe, and the flow of water and toilet waste from the water tank and toilet bowl down through the sewer pipe.
Figure 3:
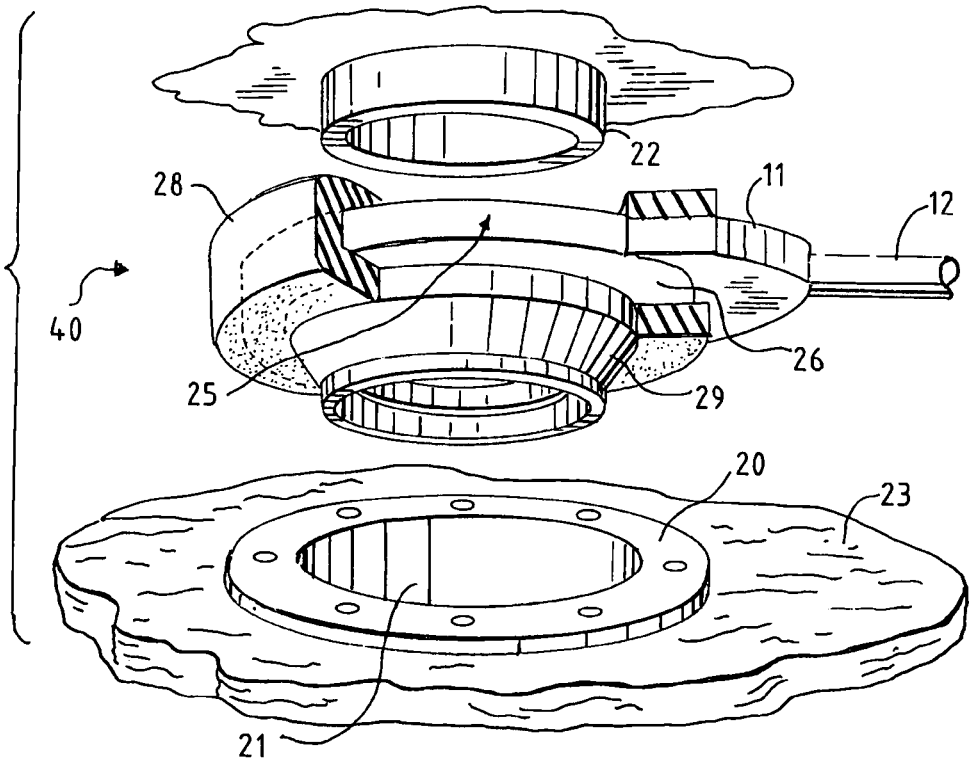
FIG. 3 is a top side, partial cross-sectional view of the adapter ring between the toilet horn and toilet flange.

Turning to the drawings, and particularly FIGS. 1 through 3, what is shown is a preferred first embodiment of the odorless toilet. The toilet 60 has seat 1, a bowl 2 and a base 3. The seat 1 has a tubular seat gas cavity 4 which is affixed to the lower surface of the seat 2. At least one intake port 5 is located on the inner, lateral surface of the seat gas cavity 4. The intake port 5 may be a single port or a plurality of ports. A gas cavity exhaust port 6 is located at the rear, lower surface of the seat 1. A seat gasket 15, as shown in FIG. 2A, is affixed to and continuously extends under the entire lower surface of the seat 1, wherein the gasket 15 is affixed no more than ½" from the peripheral edge of the lower surface of the seat 1. In one embodiment, a continuous channel 17 extends around the bottom surface of the seat 1 and is covered with a surface 18 containing at least one intake port 5 as shown in FIG. 2B. It is to be understood that the length and position of the gasket 15 can be varied to accommodate the bumpers on a toilet seat.

A fan 7 having a fan inlet (not shown) and fan exhaust (not shown) is connected to the gas cavity exhaust port 6 by a flexible exhaust hose 8, wherein the exhaust hose 8 is inserted into the fan inlet as shown in FIG. 1. The fan is connected to a one-way check valve 9 by a fan hose 10, wherein the fan hose 10 is inserted into the fan exhaust. The one-way check valve 9 is connected to an adapter inlet 11 by a flexible valve hose 12. A low voltage, sparkless motor (not shown) powers the fan 7 with a suitable wattage to prevent the risk of electric shock. An electrical connection 13 between the fan 7 and one-way check valve 9 synchronizes the one-way check valve 9 to open when the motor is activated, thereby permitting the odor to pass freely. Deactivation of the motor closes the one-way check valve 9 and prevents odor and backflow from re-entering the toilet bowl 2. It is to be understood that the one-way check valve 9 can also be operated by a mechanical means. It is to be further understood that the fan 7 can be placed in a fan unit or may be placed in a common encasing with the one-way check valve 9. It is to be further understood the one-way check valve 9 may be placed upstream of the fan 7.

A switch 14, as shown in FIG. 2A, is affixed to the lower surface of the seat 1 and activates the motor, thereby turning on the fan 7, wherein the switch 14 is located between the seat gasket 15 and the seat gas cavity 4. The switch 14 may be a mercury switch wherein the lowering of the seat 1 to a fully resting position on the toilet rim 16 triggers the switch 14. In another embodiment, the switch 14 may be a pressure switch, wherein the downward force exerted by a seated individual triggers the switch 14. In a further embodiment, the switch 14 may be replaced with a remote sensor (not shown) that is triggered by light or movement, thereby activating the motor. It is to be understood that the switch 14 can also be activated manually, wherein the switch 14 is located at a remote site such as a wall or on the side of the toilet unit and is connected to a ground fault interrupter. In a further embodiment, the switch 14 is located next to the channel 17 as shown in FIG. 2B.

Figure 4:
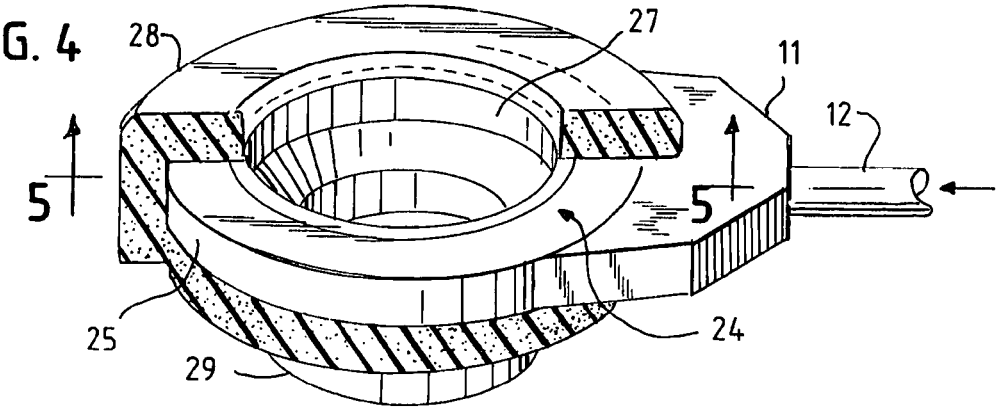
FIG. 4 is a top side, partial cross-sectional view of the adapter ring.
Figure 5:
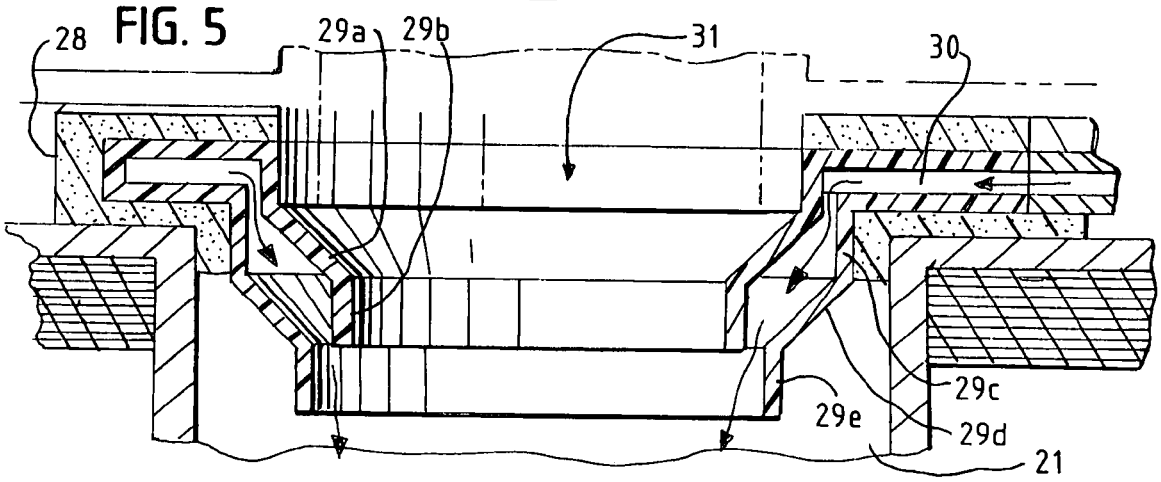
FIG. 5 is a cross-sectional view of the adapter ring seated on the toilet flange.

An adapter ring 40 having a hollow core 30, adapter inlet 11, and exhaust vent 29 is compressed between a toilet horn 22 and a sewer pipe flange 20, as shown in FIGS. 3 and 5. The adapter inlet 11 is connected to the one-way check valve 9 by a valve hose 12. The adapter ring 40 is further defined by an annular upper wall 24, an annular outer wall 25, an annular bottom wall 26, and an annular inner wall 27 as shown in FIGS. 3 through 5.

The adapter ring 40 further comprises a wax ring 28, wherein the wax ring 28 is affixed to and covers the upper wall 24, bottom wall 26, and outer wall 25, thereby providing an impermeable seal between the toilet horn 22 and adapter ring 40 when the toilet is placed on the adapter ring 40 as shown in FIG. 4. The wax ring 28 is located above the exhaust vent 29 of the adapter ring 40. The wax ring 28 is affixed to the adapter ring 40 by adhesives. The downward force of the toilet on the wax ring 28 displaces a portion of the wax ring 28 from its original shape to enhance the seal between the toilet horn 22 and the adapter ring 40 and between the adapter ring 40 and sewer pipe flange 20. The adapter ring 40 further comprises a central opening 31 to receive the toilet horn 22, as shown in FIG. 5.

The adapter ring 40 is further defined by an exhaust vent 29 which extends below the sewer pipe flange 20 as shown in FIGS. 3 and 5. The exhaust vent 29 is defined by a first wall 29*a* and a second wall 29*b*. The first wall 29*a* tapers linearly inward, wherein the diameter of the opening 31 decreases in the downward direction, thereby resulting in the inner wall 27 having a larger diameter than the first wall 29*a*, and the first wall 29*a* having a larger diameter than the second wall 29*b*. The exhaust vent 29 is further defined by a third wall 29*c*, a fourth wall 29*d*, and a fifth wall 29*e*, wherein the walls circumferentially surround the first wall 29*a* and the second wall 29*b*. The fourth wall 29*d* tapers inward linearly.

The hollow core 30 continuously extends into the exhaust vent 29. The first 29*a* and second 29*b* walls form a cavity between third 29*c*, fourth 29*d* and fifth 29*e* walls, wherein the cavity that further defines the exhaust vent 29 and permits odors to be continuously channeled from the adapter inlet 11 into the exhaust vent 29, as shown in FIG. 5.

The adapter ring 40 requires no retrofitting to an existing toilet other than the creation of a notch (not shown) no greater than ¼" to ½" by ½" to ⅝" or less, located at the lower rear base of the toilet 100. It is to be understood that the dimensions of the notch will vary with the cross-sectional shape chosen for the valve hose 12. In particular the adapter ring 40 has the advantage of not requiring any drilling of holes into 20 the bathroom floor 23. The toilet unit is placed on top of the flange 20 with the adapter 40 in between. A pair of customary flange bolts (not shown) secure the toilet in place. The adapter ring 40 can be constructed of stainless steel or hard plastic. It is to be understood that the present invention may be sold as a kit to retrofit an existing toilet or manufactured as a complete toilet system. In another embodiment, the adapter ring 40 is manufactured to be integrally formed into the toilet base 3.

The adapter ring 40 permits odor and toilet waste to enter a common sewer pipe 21 through separate points of entry. Upon triggering of the switch 14, the motor causes the fan 7 to turn on, wherein a negative pressure develops and the odor is pulled into the seat gas cavity 4 through at least one intake port(s) 5 and channeled to the gas cavity exhaust port 6 as shown in FIG. 2. The odor is exhausted from the gas cavity exhaust port 6 through the exhaust hose 8, fan inlet, fan exhaust, fan hose 10, one-way check valve 9, valve hose 12, and to the adapter inlet 11, wherein the odor is then channeled down through the exhaust vent 22, via the hollow core 30, into the sewer pipe 20. The central opening 31 of the adapter ring 40 permits unobstructed passage of waste matter from the bowl 2 through the trap 19 and toilet horn 23 and finally into a sewer pipe 21. The adapter ring 40 therefore requires to drilling of a channel from the bowl to the trap 19 because odor is independently evacuated from a distinct pathway.

Figure 6:
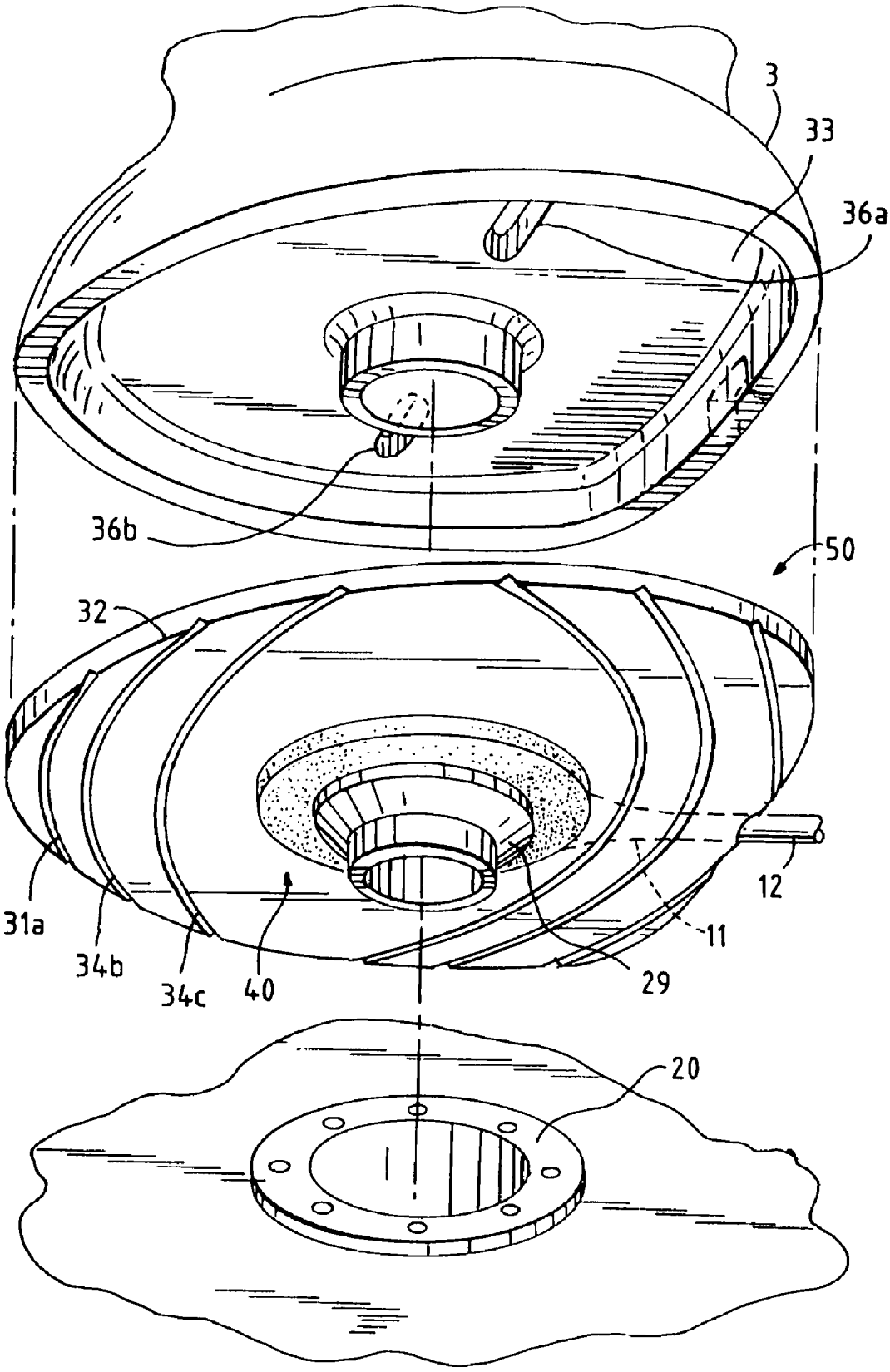
FIG. 6 is bottom side view of the adapter plate between the toilet horn and the toilet flange.

In another embodiment as shown in FIG. 6, the adapter ring 40 is affixed to a planar plate 32, thereby forming an adapter plate 50. The plate 32 is dimensioned to fit the contours of the toilet base 3, wherein the adapter plate 50 inserts into the recess 33 of the bottom toilet base 3. The plate 32 has factory perforated edges, 34*a*, 34*b*, 34*c* (generally identified as 34) that can be cut based on a homeowner's particular toilet or model. The plate 32 is comprised of plastic with a tensile strength that permits support while also allowing a homeowner to cut or break along the perforated edges 34. The plate 32 is dimensioned to have a height that accommodates the adapter inlet 11 and the valve hose 12. The height of the plate precludes the need to make a notch at the rear base of the toilet. The plate 32 further has two apertures (36*a*, 36*b*) to accommodate a pair of flange bolts. The adapter plate can be retrofitted to any existing toilet without requiring any alterations in the toilet bowl.

Figure 7:
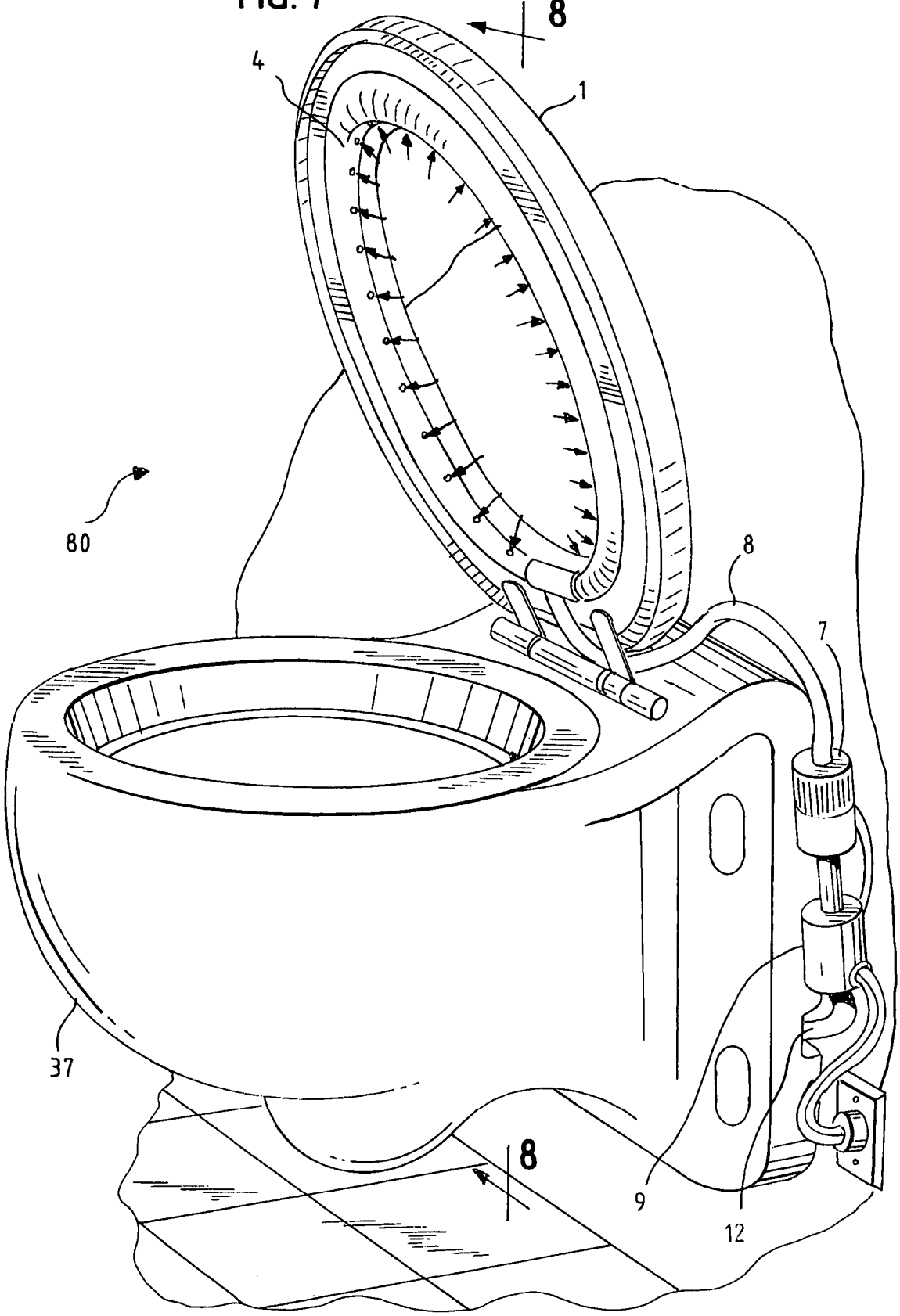
FIG. 7 is a partial isometric drawing of the odorless toilet employed in a wall mounted toilet.
Figure 8:
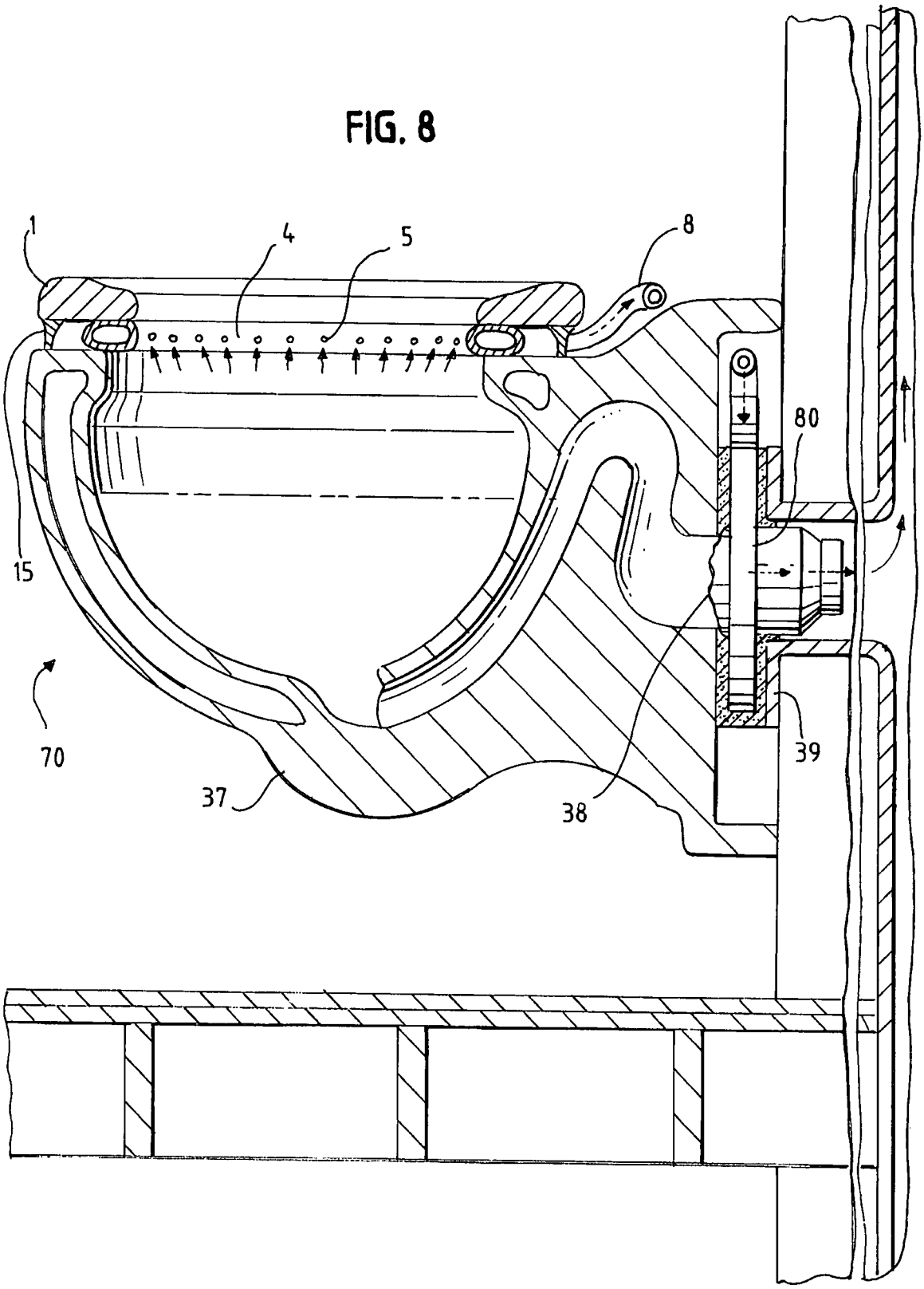
FIG. 8 is a cross sectional view of the odorless toilet employed in a wall mounted toilet.

In yet another embodiment, the odorless toilet utilizes a wall mounted toilet bowl 37, as shown in FIG. 7. An adapter ring 80 employed in the wall mounted toilet 70 is similar to the adapter ring 40 except that the adapter ring 80 of the wall mounted 70 has a sealing ring (not shown) made of neoprene, graphite felt, or a suitable material generally known to one of ordinary skill in the art, instead of the wax ring 28. The adapter ring 80 is compressed between a waste outlet 38 and the drain pipe 39, as shown in FIG. 8.

In view of the many possible embodiments to which the principles of the present invention may be applied, it should be recognized that the detailed descriptions of embodiments described in the foregoing specification are meant to be illustrative only and should not be taken as limited the scope of the invention. Accordingly many variations may be made by those skilled in the art without departing from the spirit and scope of the invention.

What is claimed is:

1. An odorless toilet comprising:

a toilet having a toilet bowl, a toilet seat and a toilet base, said toilet seat having a lower surface, a toilet horn located at said toilet base and connected to a sewer pipe flange;

a tubular seat gas cavity which is affixed to and extending around said lower surface of said toilet seat, said tubular seat gas cavity having at least an intake port located on the inner, lateral surface thereof, and a gas cavity exhaust port located at the rear thereof;

an adapter ring disposed below said toilet base and compressed between said toilet horn and said sewer pipe flange, said adapter ring having a hollow core, an adapter inlet, and an exhaust vent, wherein said adapter ring has an opening through the center thereof to receive said toilet horn and allow unobstructed passage of waste matter from said toilet bowl through said toilet horn and into a sewer pipe when the toilet is flushed;

wherein said adapter ring is defined by an annular upper wall, an annular outer wall, an annular bottom wall, and an annular inner wall, wherein said exhaust vent extending below said sewer pipe flange to channel the odor into the sewer pipe, said exhaust vent is defined by a first wall and a second wall, wherein said first wall tapers linearly inward, wherein the diameter of said opening decreases in the downward direction, thereby resulting in an inner wall having a larger diameter than said first wall, and said first wall having a larger diameter than said second wall, wherein said exhaust vent is further defined by a third wall, a fourth wall, and a fifth wall, wherein said third, fourth and fifth walls circumferentially surround said first and said second walls, wherein the fourth wall tapers inward linearly, wherein said hollow core continuously extends into said exhaust vent, said first and second walls form a cavity between third, fourth and fifth walls, wherein said cavity that further defines said exhaust vent and permits odors to be continuously channeled from said adapter inlet into said exhaust vent, wherein a wax ring is affixed to and covers said annular upper wall, said annular bottom wall, and said annular outer wall, thereby providing an impermeable seal between said toilet horn and said adapter ring when said toilet is placed on said adapter ring, wherein said wax ring is located above said exhaust vent of said adapter ring, wherein the downward force of said toilet on said wax ring displaces a portion of said wax ring from its original shape to enhance the seal between said toilet horn and said adapter ring and between said adapter ring and said sewer pipe flange, wherein said adapter ring is affixed to a planar plate, thereby forming an adapter plate, wherein said plate is dimensioned to fit the contours of said toilet base, wherein said adapter plate inserts into a recess of said bottom toilet base, wherein the plate having preformed perforated edges which allows said plate to be cut based on needs, a fan having a fan inlet and a fan exhaust, the fan inlet connected to said gas cavity exhaust port by a flexible hose and the fan exhaust connected to said adapter inlet by a fan hose and a flexible valve hose, wherein when the fan is operating, a negative pressure develops in said seat gas cavity, and the odor is pulled into said seat gas cavity through said at least one intake port and exhausted from said gas cavity exhaust port to said adapter inlet, a one-way check valve located between the fan exhaust and said adapter inlet to prevent odors and backflow from re-entering said toilet bowl;

a switch to turn the fan on and off, wherein said switch is located below the seat; and a gasket affixed to said lower surface of the seat to prevent odors from escaping said toilet bowl.

2. The odorless toilet of claim 1, wherein the switch is a mercury switch.

3. The odorless toilet of claim 1, wherein the switch is a pressure switch.

4. The odorless toilet of claim 1, wherein the adapter ring is integrally formed around the toilet horn of a toilet.

5. The odorless toilet of claim 1, wherein the adapter ring is made of plastic.

6. The odorless toilet of claim 1, wherein the adapter ring is made of stainless steel.

7. The odorless toilet of claim 1, wherein the toilet is mounted on a wall.

8. The odorless toilet of claim 1, wherein the sealing ring is neoprene.

9. The odorless toilet of claim 1, wherein the sealing ring is graphite-felt.

* * * * *